US005560516A

United States Patent [19]

Hinterreiter

[11] Patent Number: 5,560,516

[45] Date of Patent: Oct. 1, 1996

[54] TABLET DISPENSER

[75] Inventor: Ignaz Hinterreiter, Linz, Austria

[73] Assignee: Patrafico AG, Zug, Switzerland

[21] Appl. No.: 386,690

[22] Filed: Feb. 10, 1995

[51] Int. Cl.[6] ..... B65G 59/02

[52] U.S. Cl. ..... 221/247; 221/191; 221/277

[58] Field of Search ..... 221/247, 248, 221/249, 251, 226, 279, 277, 228, 229

[56] References Cited

U.S. PATENT DOCUMENTS

| | | | |
|---|---|---|---|
| 3,863,804 | 2/1975 | Infante-Diaz et al. | 221/251 |
| 3,942,683 | 3/1976 | Haas . | |
| 4,966,305 | 10/1990 | Hinterreiter | 221/229 |
| 5,048,720 | 9/1991 | Hoke | 221/229 |
| 5,071,033 | 12/1991 | Siwek | 221/229 |
| 5,080,258 | 1/1992 | Hinterreiter . | |

FOREIGN PATENT DOCUMENTS 716514 10/1954 United Kingdom .

*Primary Examiner*—William E. Terrell
*Assistant Examiner*—T. Kelly
*Attorney, Agent, or Firm*—Collard & Roe, P.C.

[57] ABSTRACT

A tablet dispenser comprises a tubular protective housing, from which a stack of tablets can be pushed. Lateral guides for the top tablet of said stack are provided in the working range of an ejector. Said lateral guides are constituted by side walls, which have side wall extensions, which are provided with outwardly directed pivot pins, which have been snap-fitted into bearing bores of the ejector when said side wall extensions have resiliently been deflected. The tablet dispenser comprises a U-shaped spring, the upper leg of which has a free end portion, which bears under pressure on a stop ledge of the ejector and is adapted to resiliently oppose a movement of said ejector out of a stand-by position. To prevent a movement of the pivot pins out of the bearing bores the free end portion of the spring constitutes a spacer, which is disposed between said side wall extensions adjacent to said pivot pins, and the sum of the distances between said spacer and said side wall extensions is smaller than the length of each of said pivot pins.

10 Claims, 3 Drawing Sheets

FIG.4
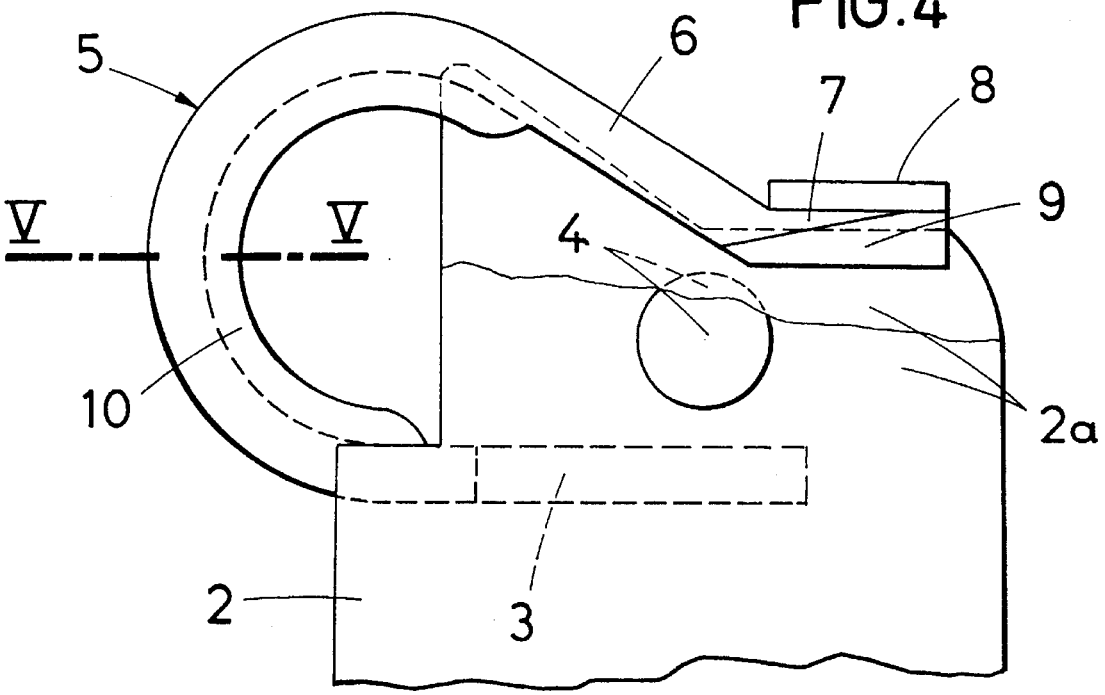
FIG.5
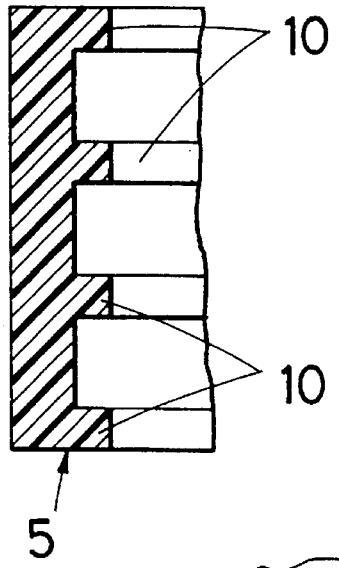
FIG.6
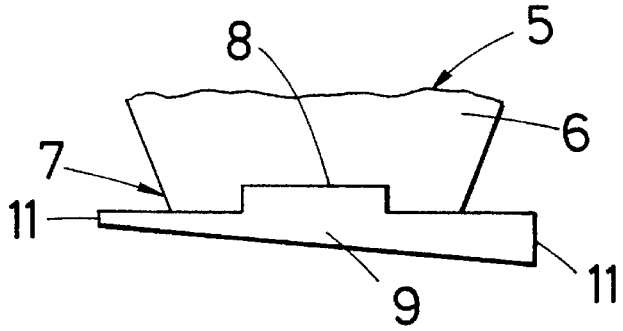
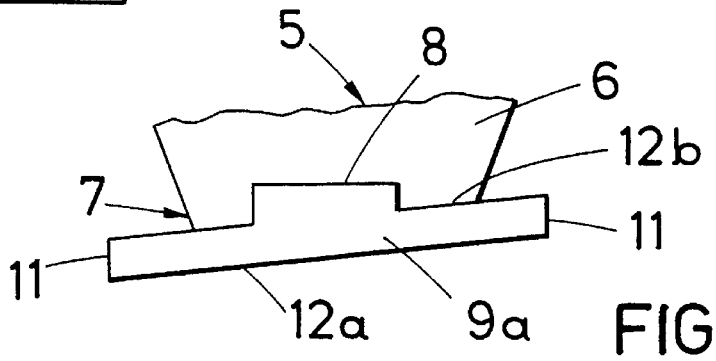
FIG.7

TABLET DISPENSER

BACKGROUND OF THE INVENTION

1. Field of the Invention

This invention relates to a tablet dispenser comprising a tubular protective housing provided with an ejection guide for tablets, which are adapted to be contained in the housing as a stack, the top tablet of which is movable into the working range of an ejector having a claw, which is movable between lateral guides transversely to the longitudinal direction of the stack to eject said top tablet. Side walls which constitute the lateral guides are interconnected by a bridge, which constitutes a stop, which is engageable by the top tablet to be ejected, and above said bridge said side walls have side wall extensions, which are provided with pivot pins, which extend outwardly transversely to the ejection direction. The ejector comprises side walls, which extend on the outside of said side wall extensions and are formed with bearing bores for receiving the pivot pins, which are adapted to snap into said bearing bores after said side wall elements have elastically been deflected inwardly. The bridge is connected to a U-shaped spring, the upper leg of which has an free end portion that at least when the ejector has been mounted extends between the side wall extensions to engage a stop of the ejector at a distance from the pivot pins to oppose a movement of said ejector from a stand-by position.

2. Description of the Prior Art

Such tablet dispensers are preferably used to dispense tablets which have a peripheral surface which is, e.g., prismatic or cylindrical so that they can easily be assembled to form a columnar stack. But such dispensers may also be used to dispense tablets having different shades. The lateral guides may consist of longitudinal ribs of the tubular protective housing. The tablet stack can be lifted by means of spring-loaded pressure-applying rams or by manually operated pushers. The lateral guides may be arranged to clamp the top tablet of the stack in a stand-by position so that is not possible to lift the stack during an ejection of the top tablet. It is also known to provide the lateral guides a drawer, which is adapted to be pushed into the protective housing.

The ejector may consist of a pivoted cap, which is provided with an ejector claw and in its stand-by position covers the top tablet and the lateral guides and/or the side wall extensions. In many cases that cap is supplemented to form a decorative ejector head, which has the same function as the cap but is designed to constitute a longer lever arm for imparting a pivotal movement to the ejector. In a known tablet dispenser of the present kind the spring is integral with the bridge and the side walls and is made of a suitably treated plastic and is reversely bent above the bridge so that the upper leg of the spring extends between the side walls in any position which it is adapted to assume. To permit the ejector to be fitted on the pivot pins simply by a snap action when the side wall extensions are forced toward each other at the top, the free end portion of the upper leg of that spring is laterally tapered and the distance between each longitudinal side edge of that free end portion and the adjacent surface of the side wall extension is at least as large as the length of each of the pivot pins. To facilitate the fitting of the ejector by a snap action, the pivot pins are relatively short and are very small in diameter, of an order of 1 to 2 mm. The free end portion of the upper leg of the spring and the stop may be so designed that the spring will oppose a movement of the ejector not only from its stand-by position but also from its Position assumed at the end of its ejecting movement so that particularly if the ejector consists of a relatively large ejector head an undesired rocking of said head in response to shakes will be prevented. In that case the stop constitutes a camming ledge for guiding the free end portion of the spring during the pivotal movement of the ejector.

A disadvantage of the known tablet dispensers resides in that the short and thin pivot pins and the side wall extensions can easily be elastically deformed by a tensile force so that the ejector may then be torn off and this may result in a fracture of the pivot pins or of the side wall extensions carrying them or in a tearing of the side walls of the ejector at the bearing bores. In that case the tablet dispenser will become inoperable and there will be a risk that, e.g., playing small children may swallow the ejector or the broken off parts of the ejector or may be injured at fractures.

SUMMARY OF THE INVENTION

For this reason it is an object of the invention to provide a tablet dispenser which is of the kind described first hereinbefore and which while preserving the advantages residing in that the ejector can easily be mounted provides a substantially reliable protection against an undesired tearing off of the ejector and permits the provision of stronger means for connecting the ejector to the remainder of the tablet dispenser.

The object set forth is accomplished in that the free end portion of the upper leg of the spring at least in that portion which is close to the pivot pins constitutes in any position which may be assumed by the mounted ejector a spacer, which extends between the side wall extensions, and the sum of the distances between said spacer and the side wall extensions is smaller than the length of each of the pivot pins.

That simple design ensures that when the ejector has been mounted it will not be possible to detach the ejector in that the side wall extensions are deflected toward each other and the bearing holls are outwardly detached from the pivot pins. It is surprising that the ejector can nevertheless be mounted in a simple manner because the free end portion of the upper leg of the spring, i.e., the spacer which is constituted by or connected to that free end portion, is rendered ineffective during the mounting operation but permits the side wall extensions to be deflected toward each other so that the pivot pins can snap into the bearing bores of the ejector.

In a modified embodiment it is possible for the mounting of the ejector to move the free end portion of the upper leg of the spring together with the spacer beyond the top edges of the side wall elements.

In a preferred embodiment that tablet dispenser or at least its part which comprises said side walls may be locked in position and in that locked position said upper leg of the spring can be twisted so that at least one edge of the free end portion of the upper leg of the spring protrudes over the top edges of the side walls, whereafter one pivot pin is inserted into the associated bearing bore and, after twisting of the upper leg of the spring in the opposite sense, the other pivot pin can be caused to snap into the associated bearing bore. If a notch for receiving the free end portion of the upper leg of the spring is provided adjacent to the stop of the ejector it will be possible to use the ejector as a tool for twisting the upper leg of the spring. When the upper leg of the spring has returned to its normal position it is positively held by the stop of the ejector in a position in which the spacer is disposed between the side wall extensions. The walls of the ejector are preferably very stiff because they have relatively thick portions adjacent to the bearing bores. The walls of the ejector may comprise bearing lugs or bearing eyes, which extend from the remainder of the ejector to the bearing bores.

According to a further feature the free end portion of the upper leg of the spring comprises a laterally tapered portion of resiliently flexible material and a plate, which constitutes said spacer and laterally protrudes from said laterally tapered portion on opposite sides thereof.

According to a further feature the free end portion of the upper leg of the spring is substantially aligned with the top edges of the side walls when the ejector has not yet been mounted and the spring is relaxed so that for the mounting of the ejector the upper leg of the spring can be twisted until at least one of the longitudinal edges of its free end portion protrudes above the top edge of the adjacent side wall.

To facilitate the twisting of the upper leg of the spring for the mounting of the ejector and yet to ensure an adequate spring action, the spring may be relatively thin adjacent to the spacer. In that case the spring will be strengthened at least adjacent to its bight in that it is formed with longitudinal ribs or combs, which are preferably tapered to gradually merge into the upper and lower legs of the spring.

The threading and unthreading of the end of the spring or of the edges of said spring between the side wall extensions can be facilitated in that the free end portion of the upper leg of the spring is beveled on the underside at least toward one longitudinal edge or the free end portion of the upper leg of the spring has a transverse inclination. In that case the pivot pin which is adjacent to the lower edge of the free end portion of the upper leg of the spring will be inserted first. Alternatively, the underside of the free end portion of the upper leg of the spring may be symmetrically or asymmetrically beveled in mutually opposite senses to form an inverted roof and in case of asymmetrical bevels that edge of the free end portion of the upper leg of the spring which is adjacent to the shorter bevel and subsequently the other edge of that free end portion will be bent out of engagement with the side wall extensions.

BRIEF DESCRIPTION OF THE DRAWING

FIG. 4 is a view showing on a larger scale a modification of the dispenser illustrated in FIG. 2.

FIG. 5 is a sectional view taken on line V—V in FIG. 4.

FIG. 6 is an elevation showing the free end portion of the upper leg of the spring.

FIG. 7 illustrates a modification of FIG. 6.

DETAILED DESCRIPTION OF THE PREFERRED EMBODIMENTS

Figure 1:
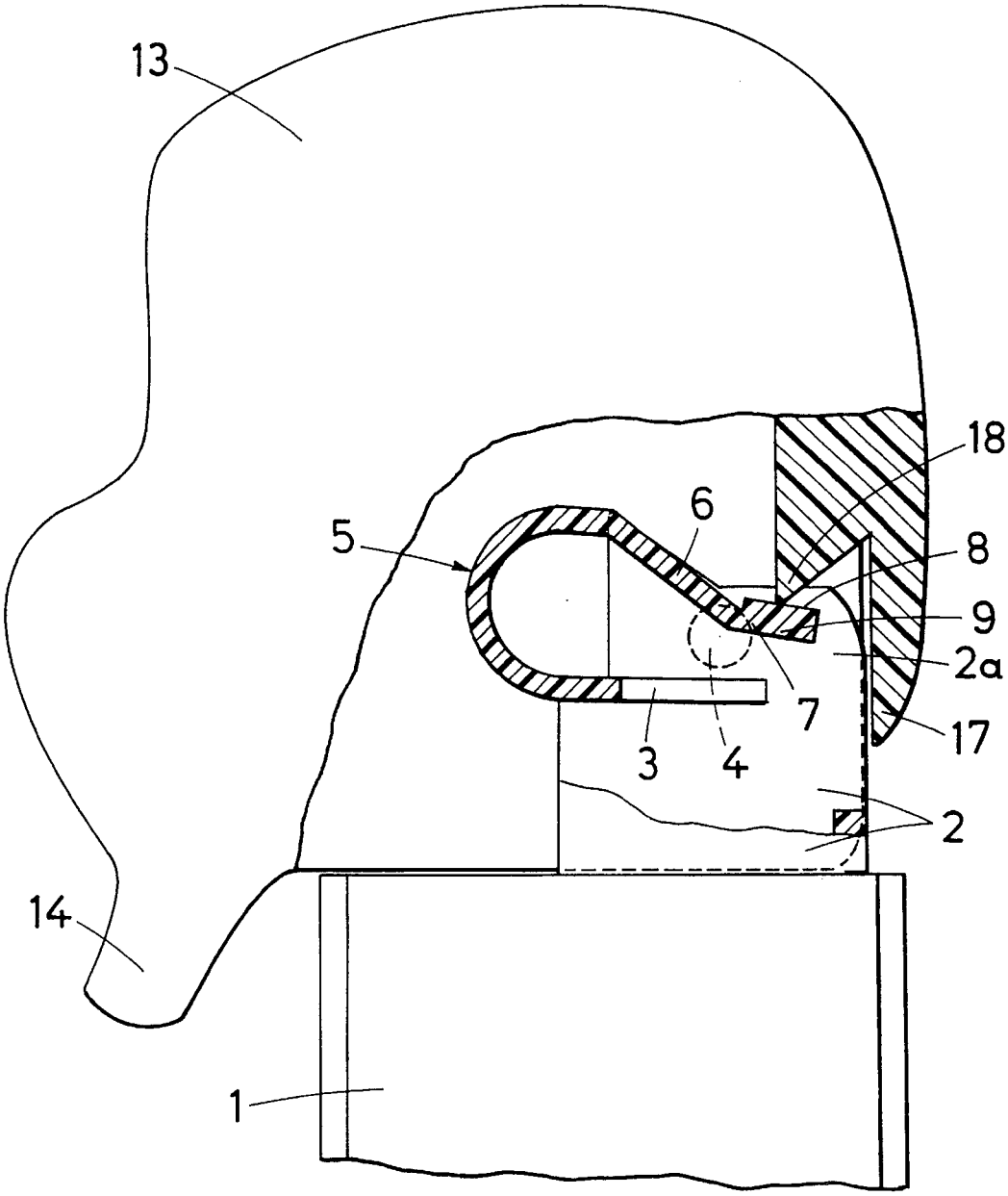
FIG. 1 shows the upper end portion of a tablet dispenser, and is in part a longitudinal sectional view showing an ejector head and the spring and in part an elevation showing other parts of the dispenser.

Further details and advantages of the subject matter of the invention will become apparent from the following detailed description with reference to the drawing.

Figure 2:
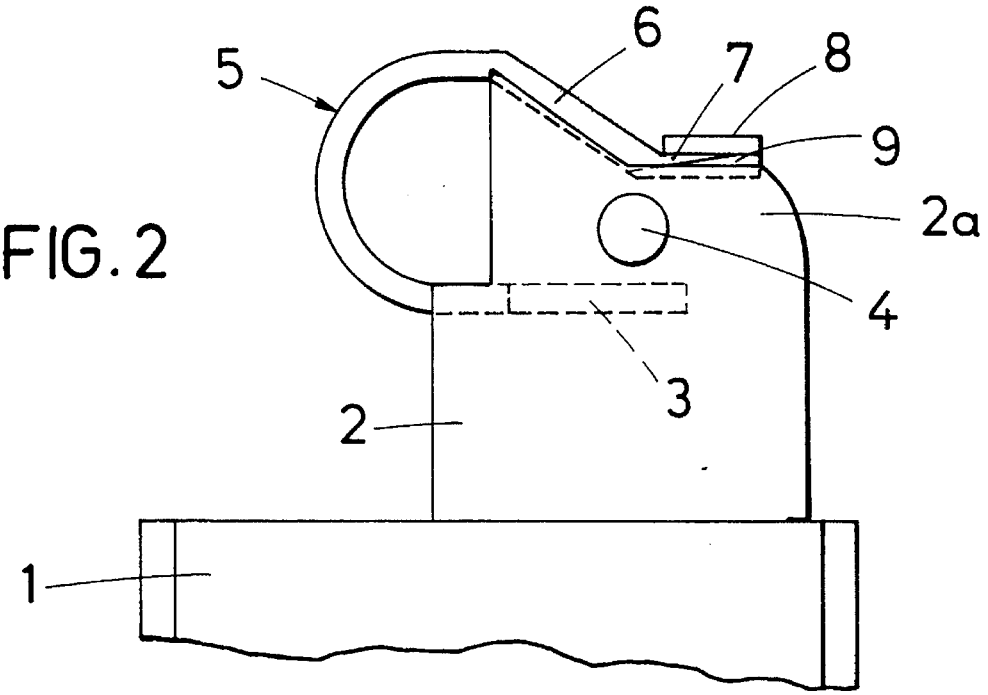
FIG. 2 is a view that is similar to FIG. 1 and shows the upper end portion of the tablet dispenser before the ejector head has been mounted.
Figure 3:
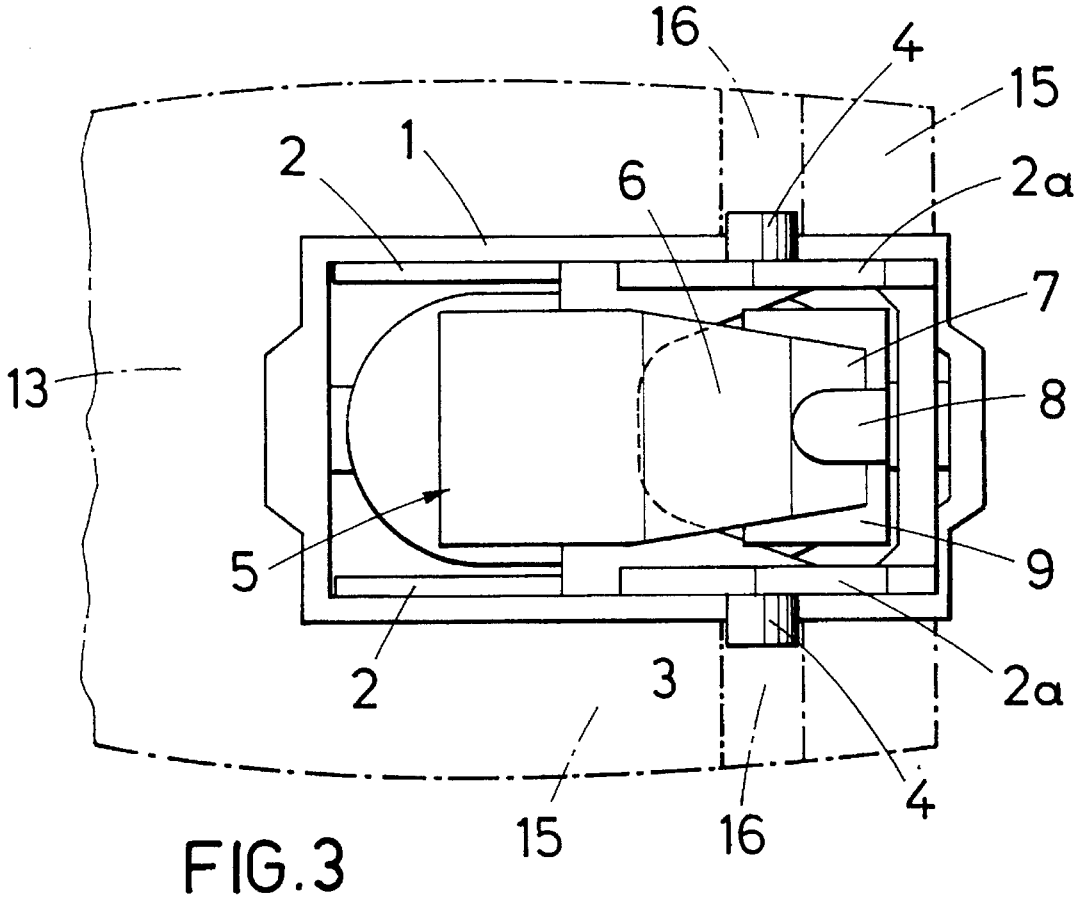
FIG. 3 is a top plan view showing the tablet dispenser of FIG. 2 and showing in phantom the contours of the ejector head.

The present tablet dispenser comprises a tubular protective housing 1, which has at its top a top opening through which the tablet at the top of a stack of tablets can be pushed out. For that purpose a pusher may be provided, which is biased by a spring or operable by hand. Alternatively the stack of tablets may be contained in a drawer, which can be extracted from the tubular protective housing 1. In dependence on the design, the protective housing 1 or the drawer is provided with side walls 2, each of which has a lower portion, which extends upwardly as far as to a transverse bridge 3, by which said side walls are connected. Said lower portions of said side walls 2 constitute lateral guides for the pushed out tablet at the top of the stack of tablets. Above the bridge 3 the side walls 2 comprise extensions **2*a*, which are narrower than the lower portions of the side walls and which are integrally formed with outwardly directed pivot pins 4, which are axially aligned. A U-shaped spring 5 comprises a lower leg, which is integrally formed with the bridge 3 and is continued by a bight, which merges into an upper leg, which comprises a downwardly inclined leg portion 6 adjacent to the bight and terminates in a free end portion 7, which is laterally tapered. That tapered end portion is integrally formed at its top with a protruding of supporting surface 8 and on its underside carries a spacer plate 9, which laterally protrudes from the tapered end portion 7 on opposite sides. When the spring 5 is relaxed in the position shown in FIGS. 2 and 4 the spacer 9 is disposed above the top edges of the extensions 2*a* of the side walls 2. The sum of the distances between the side edges of the spacer 9 and the inside surfaces of the side wall extensions 2*a* is smaller than the length of each of the pivot pins 4**.

In the embodiment shown in FIGS. 4 and 5 the spring 5 is stiffened by the provision of a plurality of longitudinal ribs or combs 10 on its bight. In the embodiment shown in FIG. 6 the bottom surface of the platelike spacer 9 is beveled to taper toward one longitudinal edge 11 of the spacer 9. In the embodiment shown in FIG. 7 the top and bottom surfaces **12*a* and 12*b* of the spacer 9*a*** are inclined in the same sense so that the entire spacer is inclined.

The illustrated tablet dispensers are provided or adapted to intend to be provided with an ejector head 13, which in its interior defines a cavity, which is open to the opening at the top of the tubular protective housing 1. The ejector head 13 has inside surfaces, which define said cavity and are in sliding contact with the outside surfaces of the side walls 2, **2*a*. The ejector head 13 is integrally formed at one end with a handle 14, which constitutes an actuating lever. The side walls 15 of the ejector head 13 are formed with two axially aligned bearing bores 16, which are adapted to receive the pivot pins 4 to define a pivotal axis. In the assembled tablet dispenser shown in FIG. 1 the ejector head 13 is pivotally movable about the pivot pins 4. At that end which is opposite to the handle 14 the ejector head 13 comprises an ejector claw 17. From a stand-by position, in which the ejector claw 17 is spaced from the side walls 2, the ejector head 13 is pivotally movable about the pivot pins 4 to move the ejector claw 17 between the side walls 2 which constitute the lateral guides for the tablet at the top of the stack. As a result, the tablet which is disposed at the top of the stack and engages the underside of the bridge 3 in a stand-by position is moved by the ejector claw 17 toward that end of the guides which has been exposed by the pivotal movement of the handle 14 and the ejector head 13. At the same end as the ejector claw 17, the ejector head 13 is provided with an internal stop ledge 18, which has front and rear surfaces, which extend at an acute angle to each other and meet at a camming edge portion, which is adapted to slidably engage the spring 5 on its supporting surface 8, which in the stand-by position of the ejector head 13 bears on the rear surface of the stop ledge 18. When the ejector head 13 is in its stand-by position shown in FIG. 1, the spring 5 bearing on the stop 1edge 18 resiliently opposes a movement of the ejector head 13 out of that position. When the ejector head 13 is pivotally moved by hand out from its stand-by position toward its open position, the supporting surface 8 of the spring 5 acts on the camming edge portion of the stop ledge 18 and finally snaps onto the front surface of the ledge 18 to be in surface contact therewith so that the spring 5 tends to oppose a movement of the ejector head 13 also from its open position. It is apparent that the spring 5 tends to oppose a movement of the ejector head 13** out of its stand-by and open positions.

In the assembling of the tablet dispenser the ejector head 13 must be mounted in that the pivot pins 4 are inserted into the bearing bores 16 of the ejector head. To that end the housing is held by one hand and the upper leg 6, 7 of the spring 5 is twisted out of its normal position shown in FIGS. 2 and 4 so that the spacer 9 assumes an oblique position and protrudes above the top edge of the side wall extension 2*a* on one side and the side wall extension 2*a* can then resiliently be inwardly deflected on that side and its pivot pin 4 can be caused to snap into the adjacent bearing bore 16. The upper leg 6, 7 of the spring 5 is subsequently twisted in the opposite sense to partly protrude above the top edge of the other side wall extension 2*a* so that said other side wall extension 2*a* can resiliently be inwardly deflected and its pivot pin 4 can be caused to snap into the adjacent bearing bore 16. When the upper leg 6, 7 of the spring 5 is then released, it will return to its untwisted position and will be forced down by the stop 1edge 18 between the side wall extensions 2*a* to such a depth that the spacer 9 is disposed between said side wall extensions 2*a* and prevents an inward deflection of the side wall extensions 2*a* so that the pivot pins 9 cannot be pulled out of the bearing bores 16.

I claim:

1. In a tablet dispenser comprising a tubular protective housing having at its top a top opening and adapted to contain a vertically movable columnar stack of tablets, which stack is vertically aligned with said top opening and comprises a top tablet, two vertical side walls spaced apart in a first horizontal direction and extending above said top opening on opposite sides thereof in a second horizontal direction, which is at right angles to said first horizontal direction, a transverse bridge connecting said side wall elements between and vertically spaced from said top opening and said top edges, whereby said top tablet is vertically movable through said top opening to a stand-by position, in which said top tablet engages said bridge and is disposed between and in sliding contact with said side wall elements, wherein said side wall elements comprise two side wall extensions extending above said bridge to said top edges, an ejector is mounted on said housing and comprises a claw and is operable from a stand-by position, in which said claw is spaced from said side wall elements, to move said claw between said side wall elements below said bridge to eject a said top tablet from said stand-by position generally in said second horizontal direction, said side wall extensions carry two pivot pins, which extend outwardly in said first horizontal direction and are axially aligned, said ejector comprises side walls extending on the outside of said side wall extensions and formed with two axially aligned bearing holes containing said pivot pins to define a pivotal axis, said side wall extensions are resiliently flexible to permit said pivot pins to snap into said bearing bores as said ejector is mounted on said side wall extensions, a U-shaped spring is provided and has a lower leg, which is connected to said bridge, an upper leg, which is spaced above said lower leg and has a free end portion having two longitudinal edges and extending between said side wall extensions, and a bight connecting said legs, said ejector has an internal stop ledge having a camming edge portion spaced from said pivotal axis and front and rear surfaces meeting at said camming edge portion generally at an acute angle, and said free end portion of said spring is adapted to bear under pressure on said rear surface adjacent to said camming edge portion to resiliently oppose a movement of said ejector out of said stand-by position, the improvement residing in that said free end portion of said spring comprises a spacer, which in any position into which said ejector is pivotally movable about said pivotal axis is disposed between said side wall extensions adjacent to said pivot pins and the sum of the distances between said spacer and the inside surfaces of said side wall extensions is smaller than the length of each of said pivot pins.

2. The improvement set forth in claim 1, wherein said free end portion of said spring comprises a laterally tapered portion of resiliently flexible material and a plate, which constitutes said spacer and laterally protrudes from said laterally tapered portion on opposite sides thereof.

3. The improvement set forth in claim 1, wherein said spring is adapted to assume a relaxed position in which said free end portion of said spring is adapted to be aligned in said first horizontal direction with said top edges when said ejector is not mounted so that said two pivot pins extend in said two bearing holes and when said spring is in said relaxed position said upper leg of the spring is adapted to be twisted so that one of said longitudinal edges of said free end portion protrudes above the adjacent one of said top edges.

4. The improvement set forth in claim 3, wherein when said spring is in said relaxed position said upper leg of the spring is adapted to be twisted in a first sense so that one of said longitudinal edges of said free end portion protrudes above said adjacent one of said top edges and said upper leg of the spring is subsequently adapted to be twisted in a second sense so that the other of said longitudinal edges of said free end portion protrudes above the other of said top edges.

5. The improvement set forth in claim 1, wherein said bight comprises at least one longitudinally extending rib.

6. The improvement set forth in claim 5, in which said at least one rib is formed with teeth.

7. The improvement set forth in claim 5, wherein said rib has longitudinally tapered end portions merging into said lower and upper legs.

8. The improvement set forth in claim 1, wherein said free end portion of said spring is beveled on the underside to one at least one of said longitudinal edges.

9. The improvement set forth in claim 1, wherein said free end portion of said spring has an underside surface which is beveled to both of said longitudinal edges in the shade of an inverted roof.

10. The improvement set forth in claim 1, wherein said free end portion of the upper leg of said spring is arranged to be in surface contact with said front surface of said stop ledge when said ejector has been pivotally moved from its stand-by position to an open position to eject the top tablet of said stack from its stand-by position so that said spring is adapted to resiliently oppose a movement of said ejector from said open position toward said stand-by position.

* * * * *